US009862908B2

(12) United States Patent
Chen et al.

(10) Patent No.: US 9,862,908 B2
(45) Date of Patent: Jan. 9, 2018

(54) SEAL SWELL ADDITIVE

(71) Applicant: CRODA, INC., Edison, NJ (US)

(72) Inventors: Xin Chen, Hockessin, DE (US); Christopher Donaghy, Garnet Valley, PA (US); Alexei Nikolaevich Kurchan, Wallingford, PA (US)

(73) Assignee: CRODA, INC., Edison, NJ (US)

( * ) Notice: Subject to any disclaimer, the term of this patent is extended or adjusted under 35 U.S.C. 154(b) by 0 days.

(21) Appl. No.: 14/372,120

(22) PCT Filed: Jan. 16, 2013

(86) PCT No.: PCT/US2013/021637

§ 371 (c)(1),
(2) Date: Jul. 14, 2014

(87) PCT Pub. No.: WO2013/109568

PCT Pub. Date: Jul. 25, 2013

(65) Prior Publication Data

US 2014/0336092 A1 Nov. 13, 2014

Related U.S. Application Data

(60) Provisional application No. 61/587,405, filed on Jan. 17, 2012.

(51) Int. Cl.
*C10M 129/74* (2006.01)
*C10M 129/76* (2006.01)

(52) U.S. Cl.
CPC ..... *C10M 129/74* (2013.01); *C10M 129/76* (2013.01); *C10M 2207/283* (2013.01); *C10M 2207/289* (2013.01); *C10N 2230/02* (2013.01); *C10N 2230/36* (2013.01); *C10N 2240/04* (2013.01); *C10N 2240/042* (2013.01); *C10N 2240/044* (2013.01); *C10N 2240/08* (2013.01); *C10N 2240/10* (2013.01)

(58) Field of Classification Search
CPC ..... C10M 129/74; C10M 129/76; C10M 2207/283; C10M 2207/289; C10N 2230/02; C10N 2230/36; C10N 2240/04; C10N 2240/042; C10N 2240/044; C10N 2240/08; C10N 2240/10
USPC ..... 508/308, 459
See application file for complete search history.

(56) References Cited

U.S. PATENT DOCUMENTS

| | | | | |
|---|---|---|---|---|
| 3,468,701 | A | 9/1969 | Hughes | |
| 4,116,877 | A | 9/1978 | Outten et al. | |
| 4,234,497 | A | 11/1980 | Honig | |
| 6,656,890 | B1 * | 12/2003 | Fish | C10M 169/00 508/570 |
| 6,693,209 | B2 * | 2/2004 | Van Es | C07D 493/04 549/483 |
| 2003/0203070 | A1 * | 10/2003 | Lin | A21D 2/16 426/25 |
| 2006/0173217 | A1 | 8/2006 | Kadkhodayan et al. | |
| 2007/0057226 | A1 | 3/2007 | Forbus | |
| 2009/0301348 | A1 * | 12/2009 | Grass | C07D 493/04 106/287.2 |
| 2010/0210487 | A1 * | 8/2010 | Deblase et al. | 508/100 |
| 2014/0315996 | A1 * | 10/2014 | Pilz | A01N 43/90 514/470 |

FOREIGN PATENT DOCUMENTS

| | | | |
|---|---|---|---|
| JP | 2000026879 | 1/2000 | |
| JP | 2001140583 | 5/2001 | |
| JP | 2009503244 | 1/2009 | |
| WO | WO 9945060 A1 * | 9/1999 | C07D 493/04 |
| WO | WO 2011/097443 A1 | 8/2011 | |

OTHER PUBLICATIONS

International Search Report of PCT/US2013/021637 (WO 2013/109568), dated Jul. 25, 2013.
Extended European Search Report for EP 13738141.4, dated Jul. 22, 2015.
Partial Translation of JP Office Action for Application No. 2014-552388, dated Jul. 12, 2016, 2 pages.

* cited by examiner

*Primary Examiner* — James Goloboy
(74) *Attorney, Agent, or Firm* — RatnerPrestia

(57) ABSTRACT

A seal swell agent for a lubricating fluid is described. The invention relates to a seal swell agent for use in lubricating oils, such as engine oils, turbine oils, automatic and manual transmission, or gear, fluids, drivetrain and gear oils and hydraulic fluids. The seal swell agent comprises a diester of sorbitol or a derivative thereof and at least one carboxylic acid. The invention extends to the use of a diester of sorbitol or a derivative thereof and at least one carboxylic acid as a seal swell agent, and a method of maintaining seal integrity.

13 Claims, No Drawings

SEAL SWELL ADDITIVE

CROSS REFERENCE TO RELATED APPLICATIONS

This application is the U.S. National Phase application of PCT International Application No. PCT/US2013/021637, filed Jan. 16, 2013, and claims priority of U.S. Provisional Patent Application No. 61/587,405 filed Jan. 17, 2012, the disclosures of which are incorporated herein by reference in their entireties for all purposes.

The present invention relates to a seal swell additive for use in lubricating oils, such as engine oils, turbine oils, automatic and manual transmission, or gear, fluids, drive-train and gear oils and hydraulic fluids. In particular, the present invention relates to the use of an isosorbide diester as a seal swell agent in mineral, hydrotreated, and/or fully synthetic base oils.

Lubricating oils typically comprise a lubricant base stock and an additive package, both of which can contribute significantly to the properties and performance of the lubricating oil.

To create a suitable lubricating oil, additives are blended into the chosen base stock. The additives either enhance the stability of the lubricant base stock or provide additional properties to the oil. Examples of lubricating oil additives include antioxidants, antiwear agents, detergents, dispersants, viscosity index improvers, defoamers and pour point depressants and friction reducing additives.

Systems that require lubricating oils usually comprise a number of seals between connecting parts. For example, between connecting parts which prevent loss of lubrication such as gaskets, o-ring seals, driveshaft seals and piston seals, or between parts which keep outside contaminants such as water, air and dust from entering the lubricating system, separate incompatible fluids and/or help maintain hydraulic system pressure, such as piston rings and o-rings in hydraulic systems.

The seals are required to maintain the integrity of the systems. Commonly, such seals are made from materials including polytetrafluoroethylene (PTFE) elastomer, fluoroelastomer (Viton) rubber, silicone, polyacrylate rubber, nitrile rubber and/or polyurethane (for hydraulic fluids).

Non-polar base oils of the type used in premium engine and driveline oils are known to cause seal shrinkage and weight loss. Additives added into the lubricating oils can add to this effect and cause even more damage to the seals. This shrinkage and weight loss experienced by the seals leads to a deterioration of the seal performance. It is a common practice to use additives in the oils to try to counteract this effect.

Traditionally, diesters of ortho-phthalic acid and alcohols have been used as seal swell agents in lubricating oils for this purpose. The additives are often used at treat rates of less than 1%. However, recent environmental and toxicological studies have shown that exposure to phthalates can have adverse effects on human and animal health.

There exists, therefore, a need to provide a seal swell agent which is effective in maintaining seal performance and is safe for the environment and human and animal health.

It is an object of the present invention to address at least one of the above disadvantages and/or other disadvantages associated with the prior art.

Thus, according to a first aspect of the present invention, there is provided a seal swell agent for a lubricating fluid comprising a diester of sorbitol or a derivative thereof and at least one carboxylic acid.

The invention further provides for the use of a diester of sorbitol or a derivative thereof and at least one carboxylic acid as a seal swell agent in a lubricating fluid.

Preferably, the seal swell agent is non-toxic.

Preferably, the sorbitol or a derivative thereof comprises a derivative of sorbitol. Preferably, the derivative of sorbitol is a dehydration derivative of sorbitol. Preferably, the derivative of sorbitol comprises a cyclic compound. Preferably, the derivative of sorbitol comprises a polycyclic compound, more preferably a bicyclic compound.

Preferably, the sorbitol or derivative thereof component is an isosorbide.

Preferably, the diester is an isosorbide diester.

The carboxylic acid may be a mono-, di- or poly-carboxylic acid. Preferably, the carboxylic acid is a monocarboxylic acid.

The carboxylic acid is preferably a $C_4$ to $C_{22}$ carboxylic acid, preferably a $C_4$ to $C_{18}$ carboxylic acid, more preferably a $C_6$ to $C_{14}$ carboxylic acid and especially a $C_8$ to $C_{12}$ carboxylic acid.

The carboxylic acid may be saturated or unsaturated. Preferably, the carboxylic acid is saturated. It has been found that saturated acids provide more stability against temperature variations and oxidation than unsaturated acids.

The carboxylic acid may be either branched or linear.

When the carboxylic acid comprises a linear acid, the linear acid is preferably free from any branched acids, for example branched isomers of the linear acid. Preferably, when the carboxylic acid comprises a linear acid, the number of carbon atoms in the linear chain is equal to the number of carbon atoms in the carboxylic acid.

Suitable linear carboxylic acids for use in the present invention include butanoic acid, hexanoic acid, octanoic acid, decanoic acid, dodecanoic acid, tetradecanoic acid, hexadecanoic acid and octadecanoic acid. Octanoic acid and decanoic acid are most preferred.

Preferably, when the carboxylic acid comprises a branched acid, the branched acid is preferably free from any linear acids, for example linear isomers of the branched acid. Preferably, when the carboxylic acid comprises a branched acid, the number of carbon atoms in the branched carboxylic acid is equal to the number of carbon atoms in the longest carbon chain plus the total of all the carbon atoms in the side branch(es).

When the carboxylic acid comprises a branched acid, the branched acid preferably comprises alkyl side branches attached directly to a carbon atom of the longest linear chain. Preferably, the alkyl side branches comprise less than 5, more preferably less than 3, and especially either 1 or 2 carbon atoms, i.e. the side branches are preferably methyl and/or ethyl groups.

In a preferred embodiment of the invention, greater than 50%, more preferably greater than 60%, particularly in the range from 70 to 97%, and especially 80 to 93% by number of the side-branched groups are methyl and/or ethyl groups. The branched carboxylic acid preferably comprises one or more alkyl side groups. The branched carboxylic acid preferably comprises up to 5 alkyl side groups, preferably up to 4 alkyl side groups and more preferably up to 3 alkyl side groups.

Preferably, the longest carbon chain in the branched chain carboxylic acid is from 3 to 21 carbon atoms long, preferably from 4 to 17 carbon atoms, more preferably from 5 to 13 carbon atoms and more preferably from 6 to 8 carbon atoms long.

Suitable branched chain carboxylic acids for use in the present invention include iso-acids such as include isobutanoic acid, isohexanoic acid, isooctanoic acid, isodecanoic acid, isododecanoic acid, isotetradecanoic acid, isohexadecanoic acid and isooctadecanoic acid; neo-acids such as neodecanioc acid; anti-iso acids; and/or other branched acids such as methylhexanoic acid, dimethylhexanoic acid, trimethylhexanoic acid, ethylheptanoic acid, ethylhexanoic acid, dimethyloctanoic acid, and the like. Preferably, the branched chain carboxylic acids are selected from the group comprising isooctanoic acid, isodecanoic acid, isononanoic acid, ethylheptanoic acid, trimethylhexanioc acid, preferably ethylheptanoic acid, trimethylhexanioc acid, more preferably 2-ethylheptanoic acid and 3,5,5-trimethylhexanioc acid.

In one embodiment, the carboxylic acid may comprise a mixture of two or more carboxylic acids.

When present as a mixture, the carboxylic acids may comprise a mixture of linear acids, branched acids, or linear and branched acids. Preferably, where a mixture of acids is present, the mixture comprises $C_4$ to $C_{22}$ carboxylic acids, preferably $C_4$ to $C_{18}$ carboxylic acids, more preferably $C_6$ to $C_{14}$ carboxylic acids, and especially $C_8$ to $C_{12}$ carboxylic acids.

Carboxylic acids suitable for use herein can be obtained from natural sources such as, for example plant or animal esters. For example, the acids may be obtained from palm oil, rape seed oil, palm kernel oil, coconut oil, babassu oil, soybean oil, castor oil, sunflower oil, olive oil, linseed oil, cottonseed oil, safflower oil, tallow, whale or fish oils, grease, lard and mixtures thereof. The acids may also/alternatively be synthetically prepared. Relatively pure unsaturated acids such as oleic acid, linoleic acid, linolenic acid, palmitoleic acid, and elaidic acid may be isolated, or relatively crude unsaturated acid mixtures employed. Resin acids, such as those present in tall oil, may also be used.

Preferably, the seal swell agent is stable at a range of temperatures. Preferably, the seal swell agent exhibits good stability at both low temperatures and high temperatures. Preferably, the seal swell agent is stable at temperatures of down to at least −20° C., preferably down to at least −30° C., more preferably down to at least −50° C. and especially down to at least −60° C. Preferably, the seal swell agent is stable at temperatures of up to at least 100° C., preferably up to at least 150° C., more preferably up to at least 200° C. and especially up to at least 220° C. The temperature stability is determined according to the off-set of the weight loss curve on thermogravimetric analysis (TGA) of the seal swell agent in air.

Preferably, the seal swell agent has a kinematic viscosity of at least 0.1 cSt, preferably at least 1 cSt, more preferably at least 2 cSt and especially at least 3 cSt at 100° C. Preferably, the seal swell agent has a kinematic viscosity of up to 100 cSt, preferably up to 80 cSt, more preferably up to 50 cSt and especially up to 20 cSt at 100° C.

Preferably, the seal swell agent is anhydrous. By the term "anhydrous", it is meant that the seal swell agent preferably comprises a maximum of 5% by weight water. More preferably, the active compound comprises a maximum of 2% by weight water, most preferably, 1% and desirably 0.5% by weight. Preferably, the compound comprises 0.001% to 5% by weight water, preferably 0.01% to 2%, most preferably 0.01% to 0.5% by weight water.

Preferably, the seal swell agent is oil-soluble. By the term "oil soluble", it is meant that the seal swell agent dissolves completely in oil forming a continuous oil phase.

According to a second aspect of the invention, there is provided a lubricating fluid comprising a base fluid and a seal swell additive, wherein the seal swell additive comprises a diester of sorbitol or a derivative thereof and at least one carboxylic acid.

Preferably, the base fluid is an oil, preferably a natural oil or a synthetic oil. The base fluid may be selected from the group comprising mineral oils, preferably hydrotreated mineral oils, more particularly hydroteated mineral oils; and synthetic base oils, such as polyalphaolefins and Fischer-Tropsch gas-to-liquid baseoils.

The base fluid may be selected as appropriate for different lubricating fluids.

By the term lubricating fluid, it is meant any fluid which has, as a primary or secondary purpose, a lubricating functionality. Preferably, the lubricating fluid is a fluid which can be used in the lubrication and power transmission fluids of automotive systems, for example engine oils, power and automatic transmission fluids, turbine oils, drivetrain oils, gear oils, hydraulic fluids and fuels; known from hereon in as automotive lubricants. The lubricating fluids may also be fluids which are used in the lubrication and power transfer fluids of industrial gear oils and hydraulic systems.

For an automotive engine lubricating fluid, the term base fluid includes both gasoline and diesel (including heavy duty diesel (HDDEO)) engine oils. The base fluid may be chosen from any of the Group I to Group VI base oils (which includes Group $III^+$ gas to liquid) as defined by the American Petroleum Institute (API) or a mixture thereof. Preferably the base fluid has one of Gp II, Gp III or a Gp IV base oil as its major component. By the term major component, it is meant at least 50% by weight of base fluid, preferably at least 65%, more preferably at least 75%, especially at least 85%. The base fluid typically ranges from 0 W to 25 W. The viscosity index is preferably at least 90 and more preferably at least 105. The Noack volatility, measured according to ASTM D-5800, is preferably less than 20%, more preferably less than 15%.

The base fluid for an automotive engine lubricating fluid may also comprise as a minor component, preferably less than 30%, more preferably less than 20%, especially less than 10% of any or a mixture of Group III+, IV and/or Group V base fluids which have not been used as the major component in the base fluid. Examples of such Group V base fluids include alkyl naphthalenes, alkyl aromatics, vegetable oils, esters, for example monoesters, diesters and polyol esters, polycarbonates, silicone oils and polyalkylene glycols. More than one type of Group V base fluid may be present. Preferred Group V base fluids are esters, particularly polyol esters.

For automotive engine lubricating fluids the seal swell additive is present at a concentration in the range of from 0.01% to 15% of the automotive lubricating fluid, preferably from 0.05 to 10%, more preferably from 0.1 to 5% and especially from 0.1 to 1% by weight based on the total weight of the lubricating fluid.

For fuel lubricating fluids the term base stock includes both gasoline and diesel fuels.

For a gear lubricating fluid, including both industrial (including power generation equipment gearboxes) and automotive gearbox and driveline lubricating fluids, the base fluid may be chosen from any of the Group I to Group VI base oils (which includes Group $III^+$ gas to liquid) as defined by the American Petroleum Institute (API) or a mixture thereof. Preferably the base fluid has one of Gp II, Gp III or a Gp IV base oil as its major component. By the term major component, it is meant at least 50% by weight of base fluid. Preferably, the base fluid kinematic viscosity at 100C is from about 2 to about 15 cSt (mm2/sec).

The base fluid for a gear and/or driveline lubricating fluid may also comprise as a minor component, preferably less than 30%, Group III+, IV and/or Group V base fluids which have not been used as the major component in the base fluid. Examples of such Group V base fluids include alkyl naphthalenes, alkyl aromatics, vegetable oils, esters, for example monoesters, diesters and polyol esters, polycarbonates, silicone oils and polyalkylene glycols. More than one type of Group V base fluid may be present. Preferred Group V base fluids are esters, particularly polyol esters.

For gear (including industrial, power generation and automotive gear lubricants) and driveline lubricating fluids the seal swell additive is present at a concentration in the range of from 0.01% to 15% of the lubricating fluid, preferably from 0.05 to 10%, more preferably from 0.1 to 5% and especially from 0.1 to 2% by weight based on the total weight of the lubricating fluid.

For a hydraulic lubricating fluid the base fluid may be chosen from any of the Group I to Group VI base oils (which includes Group III$^+$ gas to liquid) as defined by the American Petroleum Institute (API) or a mixture thereof. Preferably the base fluid has one of Gp II, Gp III or a Gp IV base oil as its major component. By the term major component, it is meant at least 40% by weight of base fluid. Preferably, the base fluid kinematic viscosity at 100C is from about 2 to about 15 cSt (mm2/sec).

The base fluid for a hydraulic lubricating fluid may also comprise as a minor component, preferably less than 30%, Group III+, IV and/or Group V base fluids which have not been used as the major component in the base fluid. Examples of such Group V base fluids include alkyl naphthalenes, alkyl aromatics, vegetable oils, esters, for example monoesters, diesters and polyol esters, polycarbonates, silicone oils and polyalkylene glycols. More than one type of Group V base fluid may be present. Preferred Group V base fluids are esters, particularly polyol esters.

For hydraulic lubricating fluids the seal swell additive is present at a concentration in the range of from 0.01% to 15% of the lubricating fluid, preferably from 0.05 to 10%, more preferably from 0.1 to 5% and especially from 0.1 to 2% by weight based on the total weight of the lubricating fluid.

In each of the different types of lubricating fluid described above, the base fluid may also comprise other types of additives of known functionality at concentrations of from 0.1 to 30%, more preferably from 0.5 to 20% and more especially from 1 to 10% of the total weight of the lubricating fluid. These can include friction modifiers, detergents, dispersants, oxidation inhibitors, corrosion inhibitors, including copper corrosion inhibitors, rust inhibitors, antiwear additives, extreme pressure additives, foam depressants, pour point depressants, viscosity index improvers, metal deactivators, deposit modifiers, anti stat agents, lubricity agents, demulsifiers, wax anti-settling agents, dyes, anti valve seat recession additives, and mixtures thereof.

Examples of suitable viscosity index improvers include polyisobubutenes, polymethacrylate acid esters, propylene/ethylene copolymers, polyacrylate acid esters, diene polymers, polyalkyl styrenes, alkenyl aryl conjugated diene copolymers and polyolefins. Preferably, one or more viscosity modifier(s) is/are present in the lubricating fluid at a concentration of 0.5% to 30%, more preferably from 2 to 20% and especially from 3 to 10% by weight based on the total weight of the lubricating fluid.

Examples of suitable foam depressants include silicones and organic polymers. Preferably, one or more foam depressant(s) is/are present in the lubricating fluid at a concentration of from 5 to 500 parts by million based on the total lubricating fluid.

Examples of suitable pour point depressants include polymethacrylates, polyacrylates, polyacrylamides, condensation products of haloparaffin waxes and aromatic compounds; vinyl carboxylate polymers, terpolymers of dialkylfumarates, vinyl esters of fatty acids and alkyl vinyl ethers.

Examples of suitable ashless detergents include carboxylic dispersants, amine dispersants, Mannich dispersants and polymeric dispersants. Preferably, one or more ashless detergent(s) is/are present in the lubricating fluid at a concentration of 0.1% to 15%, more preferably from 0.5 to 10% and especially from 2 to 6% by weight based on the total weight of the lubricating fluid.

Examples of suitable ash-containing dispersants include neutral and basic alkaline earth metal salts of an acidic organic compound. Preferably, one or more ash-containing dispersant(s) is/are present in the lubricating fluid at a concentration of 0.01% to 15%, more preferably from 0.1 to 10% and especially from 0.5 to 5% by weight based on the total weight of the lubricating fluid.

Examples of suitable antiwear additives include ZDDP, ashless and ash containing organic phosphorous and organosulphur compounds, boron compounds, and organo-molybdenum compounds. Preferably, one or more antiwear additive(s) is/are present in the lubricating fluid at a concentration of 0.01% to 30%, more preferably from 0.05 to 20% and especially from 0.1 to 10% by weight based on the total weight of the lubricating fluid for phosphorus-containing additives, and at a concentration of 0.01% to 15%, more preferably from 0.1 to 10% and especially from 0.5 to 5% by weight based on the total weight of the lubricating fluid for sulphur-only-containing additives. The concentration of antiwear additive(s) present in the lubricating fluid must allow for the fluid to pass local and industry standard performance tests and regulations.

Examples of suitable extreme pressure additives (EP-additives) include those sulphur and phosphorus-based compounds as described above as antiwear additives, as well as sulfurized isobutylenes (SIBs), thiadiazoles and their derivatives (dialkyl thiadiazoles, salts with amines, thioesters and others), thiocarbamates, thiouranes, oil-soluble organic phosphorus-containing compounds and others.

Preferably, one or more EP-additive(s) is/are present in the lubricating fluid at a concentration of about 0.1 to about 7 wt % of at least one oil-soluble organic sulfur-containing EP-additive having a sulfur content of at least about 20% by weight, or about 0.2 to about 3 wt % of at least one oil-soluble organic phosphorus-containing EP-additive, both wt % values being based on the total weight of the lubricating fluid.

Examples of suitable oxidation inhibitors include hindered phenols and alkyl diphenylamines. Preferably, one or more oxidation inhibitor(s) is/are present in the lubricating fluid at a concentration of 0.01% to 7%, more preferably from 0.05 to 5% and especially from 0.1 to 3% by weight based on the total weight of the lubricating fluid.

Examples of suitable copper corrosion inhibitors include azoles, amines, amino acids. Preferably one or more oil soluble copper corrosion inhibitor(s) is/are present in the lubricating fluid at a concentration of about 0.05 to about 0.35 wt % based on the total weight of the lubricating fluid.

Examples of suitable oil-soluble rust inhibitors include metal petroleum sulphonates, carboxylic acids, amines and sarcosinates. Preferably one or more rust inhibitor is present in the lubricating fluid at a concentration of about 0.1 to about 0.8 wt % based on the total weight of the lubricating fluid.

The additional additives described above may have more than one functionality within the lubricating fluid.

The present invention provides a seal swell agent and additive for a lubricating fluid which provides an effective seal swelling functionality, but which is non-toxic, and therefore does not suffer from the disadvantages of phthalate-based seal swell agents.

Any of the above-described features of the present invention may be taken in any combination and with any aspect of the invention.

EXAMPLES

The invention will now be illustrated further by the following non-limiting examples. All parts and percentages are given by weight of the total composition unless otherwise stated.

1) Preparation

A variety of diesters of isosorbide were prepared by combining isosorbide and carboxylic acids, as listed in Table 1 below, in a batch reactor fitted with a mechanical stirrer, inert gas sparger, vapour column, condenser, and distillate receiver. The acid was present in slight excess from 5 to 15% molar—the higher excess of acid, the faster the reaction reaches completion. The pressure in the batch reactor was controlled by a vacuum pump that was attached to the reactor.

Anywhere from 0.05 to 0.5 parts of catalyst per 100 parts of acid was added to the reaction mixture, and the mixture was heated to from about 180° C. to about 220° C. The catalysts used were not reaction specific and were selected from a group of effective catalysts. The group of effective catalysts includes but is not limited to tetrabutyltitanate, phosphorus acid, sodium hypophosphite, tin oxalate and others. The colour of the product was significantly lightened by using sodium hypophosphite as a co-catalyst at 0.02-0.1 (mass percent) concentrations. The pressure in the batch reactor was slowly reduced until sufficient conversion to the desired product was reached.

The excess acid was removed from the reaction product by vacuum distillation. The crude ester was further purified by steam distillation and treatment with hydrogen peroxide/water, followed by filtration with filter-aid. The resulting ester generally was a clear, slightly yellow to brownish liquid possessing the typical properties outlined in Table 1 below.

TABLE 1

Isosorbide diesters and their properties

| Chemistry | KV40 (ASTM D445) | KV100 (ASTM D445) | VI (ASTM D2270) | Flash Point, ° C. | Pour Point, ° C. | Acid Number |
|---|---|---|---|---|---|---|
| Isosorbide Di-Hexanoate | 17 | 3.7 | 104 | 210 | −57 | <1 |
| Isosorbide Di-Octoate | 23 | 4.6 | 117 | 241 | 5.9 | <1 |
| Isosorbide Di-Decanoate | Solid | | N/A | | | <1 |
| Isosorbide diester with C-810 Caprylic/Capric Acid mix from Procter & Gamble Chemicals | 26.9 | 5.9 | 173 | 244 | −8.3 | <1 |
| Isosorbide diester with 2-Ethyl-Hexanoic acid | 32.3 | 4.5 | 48.1 | 231 | −45.5 | <1 |
| Isosorbide diester 3,5,5-trimethylhexanoic acid | 70.3 | 7.4 | 48 | 253 | −24.5 | <1 |

2) Experimental Evaluation

In order to evaluate the efficiency of various materials as seal swell agents, the conditions from the ASTM D7216-05 (Standard Test Method for Determining Automotive Engine Oil Compatibility with Typical Seal Elastomers) were used and followed. Materials were blended into PAO 4 (standard grade from global manufacturer) at several treat rates, or concentrations. Elastomer specimens of hydrogenated nitrile butadiene rubber (HNBR), polyacrylate or acrylic rubber (ACM), fluoropolymer elastomers (Viton) (FKM) and silicone rubber (VMQ) were obtained from ASTM authorized suppliers for GF-5 testing.

Seal swell agents, both of the type falling within the scope of the present invention (agents 1 to 5) and a number of comparative agents (agents A to G), were blended with PAO at 66° C. for 1 hour at 0.5, 2.5 and 10% treat rates.

Elastomer specimens were cut, and weight and volume values were measured before and after testing in accordance with ASTM D7216-05 method description.

HNBR elastomers were tested by suspending the test specimen in prescribed amount of lubricating oils at 100° C. for 366 hours. All other elastomers were tested in a similar manner at 150° C. (according to ASTM test procedure). All tests were carried out in duplicate. At the end of the test period, the test rubber specimens were removed from the test oil and placed on lint-free tissue. Excess oil was removed from the specimens with clean, absorbent towel before the weights and volumes were measured. The difference in weight and volume of each of the specimens as a result of the exposure to the seal swell agents was calculated by comparing the measurements taken after the exposure with those taken before the exposure.

The results for each of the tested seal swell agents on each of the elastomers are given below in Tables 2, 3, 4 and 5.

TABLE 2

| Seal Swell Agents with HNBR Elastomer | | | | | | | |
|---|---|---|---|---|---|---|---|
| | | 0.5% concentration | | 2.5% concentration | | 10% concentration | |
| Agent Name | Agent Chemistry | Mass change, % | Volume change, % | Mass change, % | Volume change, % | Mass change, % | Volume change, % |
| 1 | Isosorbide Dihexanoate | −2.8 | −2.5 | −1 | −1.2 | 6.85 | 4.7 |
| 2 | Isosorbide Dioctanoate | −2.9 | −2.7 | −1 | −0.8 | 2.5 | 3 |
| 3 | Isosorbide Didecanoate | −3.1 | −3 | −1.6 | −1.9 | 1.9 | 1.5 |
| 4 | Isosorbide Di-2-Ethylhexanoate | −3.9 | −3 | −1.5 | −1.7 | 1.7 | 0.9 |
| 5 | Isosorbide Di-3,5,5'-trimethylhexanoate | −2.6 | −2.4 | −2.4 | 1.9 | 1 | 2 |
| A | Di-n-hexyl Phthalate | −2.9 | −2.8 | −1.2 | −1 | 4.4 | 3.9 |
| B | Di-n-octyl Phthalate | −3.1 | −2.5 | −2.1 | −1.8 | 2.1 | 2.4 |
| C | Di-n-dodecyl Phthalate | −3.1 | −2.2 | −2.8 | −2.4 | 1.3 | 1 |
| D | Di-2-Ethylhexyl Phthalate | −3.6 | −2.3 | −3.2 | −1.9 | 2.7 | 1.9 |
| E | 2-Ethylhexyl benzoate | | | −2.19 | −2.2 | 0.99 | 0.7 |
| F | Di-isodecyl adipate | | | | | −1.64 | −1.2 |
| G | PAO 4 (no Additive) | −4.45 | −4.1 | −4.45 | −4.1 | −4.45 | −4.1 |

TABLE 3

| Seal Swell Agents with FKM Elastomer | | | | | | | |
|---|---|---|---|---|---|---|---|
| | | 0.5% concentration | | 2.5% concentration | | 10% concentration | |
| Agent Name | Agent Chemistry | Mass change, % | Volume change, % | Mass change, % | Volume change, % | Mass change, % | Volume change, % |
| 1 | Isosorbide Dihexanoate | −0.1 | 0 | 1.1 | 0.5 | 11.3 | 12 |
| 2 | Isosorbide Dioctanoate | −0.2 | 0 | 0.6 | 0.2 | 5.9 | 5 |
| 3 | Isosorbide Didecanoate | 0 | −0.1 | 0 | −0.2 | 0.9 | 0.7 |
| 4 | Isosorbide Di-2-Ethylhexanoate | 0 | −0.3 | 0.1 | 0 | 0.9 | 0.3 |
| 5 | Isosorbide Di-3,5,5'-trimethylhexanoate | −0.4 | −0.6 | 0 | 0.3 | 1.5 | 3.9 |
| A | Di-n-hexyl Phthalate | −0.1 | 0.1 | 0.2 | 0 | 1 | 0.4 |
| B | Di-n-octyl Phthalate | −0.2 | 0 | 0.4 | 0.1 | 0.7 | 0.6 |
| C | Di-n-dodecyl Phthalate | −0.1 | 0 | 0.28 | 0.1 | 0.5 | 0.4 |
| D | Di-2-Ethylhexyl Phthalate | −0.2 | −0.7 | −0.3 | −0.5 | 0.7 | 0.3 |
| E | 2-Ethylhexyl benzoate | | | 0.6 | 0.3 | 0.8 | 0.3 |
| F | Di-isodecyl adipate | | | | | −0.3 | −0.2 |
| G | PAO 4 (no Additive) | −0.1 | 0 | −0.1 | 0 | −0.1 | 0 |

TABLE 4

| Seal Swell Agents with ACM Elastomer | | | | | | | |
|---|---|---|---|---|---|---|---|
| | | 0.5% concentration | | 2.5% concentration | | 10% concentration | |
| Agent Name | Agent Chemistry | Mass change, % | Volume change, % | Mass change, % | Volume change, % | Mass change, % | Volume change, % |
| 1 | Isosorbide Dihexanoate | −2.3 | −2.1 | 0.4 | 0.5 | 17 | 15 |
| 2 | Isosorbide Dioctanoate | −2.5 | 1.9 | −1.5 | −1.2 | 4.3 | 3.7 |
| 3 | Isosorbide Didecanoate | −2.6 | −2.8 | −0.7 | −0.2 | 5.25 | 4 |
| 4 | Isosorbide Di-2-Ethylhexanoate | −1.4 | −0.6 | 0 | −0.8 | 2.2 | 1.4 |
| 5 | Isosorbide Di-3,5,5'-trimethylhexanoate | −2.7 | −3 | −1.7 | −1.3 | 1.4 | 0.4 |
| A | Di-n-hexyl Phthalate | −2.9 | −2.2 | −1.8 | −1.5 | 4.9 | 4 |
| B | Di-n-octyl Phthalate | −2.5 | −2 | −1.9 | −1.5 | −0.5 | 0.1 |
| C | Di-n-dodecyl Phthalate | −3.1 | −3.2 | −2.6 | −2.2 | −1.2 | −1.1 |
| D | Di-2-Ethylhexyl Phthalate | −2.5 | −2.7 | −2 | −1.4 | 1.8 | 1 |
| E | 2-Ethylhexyl benzoate | | | −2.6 | −1.8 | 1.2 | 0.5 |
| F | Di-isodecyl adipate | | | | | −1.2 | −0.7 |
| G | PAO 4 (no Additive) | −2.4 | −2 | −2.4 | −2 | −2.4 | −2 |

TABLE 5

| Seal Swell Agents with VMQ Elastomer | | | | | | | |
|---|---|---|---|---|---|---|---|
| | | 0.5% concentration | | 2.5% concentration | | 10% concentration | |
| Agent Name | Agent Chemistry | Mass change, % | Volume change, % | Mass change, % | Volume change, % | Mass change, % | Volume change, % |
| 1 | Isosorbide Dihexanoate | 17 | 15 | 7 | 6 | 17 | 19 |
| 2 | Isosorbide Dioctanoate | 5 | 5 | 7 | 5 | 28 | 25 |
| 3 | Isosorbide Didecanoate | 5 | 3 | 8 | 5 | 13 | 12 |
| A | Di-n-hexyl Phthalate | 5 | 4 | 5 | 4 | 6.5 | 5 |
| B | Di-n-octyl Phthalate | 5 | 3 | 6 | 5 | 16 | 13 |
| C | Di-n-dodecyl Phthalate | 5 | 4 | 5 | 5 | 6 | 5 |
| D | Di-2-Ethylhexyl Phthalate | | | 6.8 | 6 | 9.8 | 11 |
| E | 2-Ethylhexyl benzoate | | | | | 6 | 5 |
| G | PAO 4 (no Additive) | 4.5 | 3 | 4.5 | 3 | 4.5 | 3 |

In the results, a positive number corresponds to an increase in mass and/or volume due to exposure to the seal swell agents, and a negative number corresponds to a decrease in mass and/or volume due to exposure to the seal swell agents. A good result in these tests is a positive number—the higher the number, the better performance the seal swell agent exhibits.

The results indicate that isosorbide diesters, e.g. agents 1, 2, 3, 4 and 5 are as effective as similar molecular weight phthalates, i.e. comparative agents A, B, C and D in preventing weight loss and volume shrinkage of the HNBR elastomer. Whereas, for the FKM and ACM elastomers, the effectiveness of agents 1, 2, 3, 4 and 5 were similar to that of comparative agents A, B, C and D at lower treat rates but significantly more effective at higher concentrations.

Any or all of the disclosed features, and/or any or all of the steps of any method or process described, may be combined in any combination.

Each feature disclosed herein may be replaced by alternative features serving the same, equivalent or similar purpose. Therefore, each feature disclosed is one example only of a generic series of equivalent or similar features.

The above statements apply unless expressly stated otherwise. The term specification, for these purposes, includes the description and any accompanying claims, abstract and drawings.

The invention claimed is:

1. A lubricating oil comprising a base oil and a seal swell additive, wherein the seal swell additive comprises a diester of an isosorbide and a mixture of at least two carboxylic acids, wherein the diester is present in a concentration ranging from 0.01% to 15% by weight based on the total weight of the lubricating oil, wherein the mixture of at least two carboxylic acids consists of $C_4$ to $C_{12}$ carboxylic acids, wherein the base oil is selected from Group I to Group V base oils having a kinematic viscosity from 2 to 15 cSt at 100° C., and wherein the lubricating oil is selected from the group consisting of an engine oil, drivetrain oil, gear oil, manual and automatic transmission fluids, turbine oil, and hydraulic fluids.

2. A method of maintaining the seal integrity of natural and/or synthetic rubber seals in a lubricated system, the method comprising adding a seal swell agent to a lubricating oil present in the lubricating system, the seal swell agent comprising a diester of an isosorbide and a mixture of at least two carboxylic acids, wherein the diester is present in a concentration ranging from 0.01% to 15% by weight based on the total weight of the lubricating oil, wherein the mixture of at least two carboxylic acids consists of $C_4$ to $C_{12}$ carboxylic acids, wherein the lubricating oil comprises a base oil selected from Group I to Group V base oils having a kinematic viscosity from 2 to 15 cSt at 100° C., and wherein the lubricating oil is selected from the group consisting of an engine oil, drivetrain oil, gear oil, manual and automatic transmission fluids, turbine oil, and hydraulic fluid.

3. The lubricating oil of claim 1, wherein the seal swell agent is stable from −20° C. to 100° C.

4. The lubricating oil of claim 1, wherein the seal swell agent has a kinematic viscosity of at least 0.1 cSt, and up to 100 cSt at 100° C.

5. The lubricating oil of claim 1, wherein the seal swell agent is anhydrous.

6. The lubricating oil of claim 1, wherein the seal swell agent is oil-soluble.

7. The lubricating fluid oil of claim 1, wherein the diester is present in a concentration ranging from 0.05% to 15% by weight based on the total weight of the lubricating oil.

8. The lubricating oil of claim 1, wherein the diester is present in a concentration ranging from 0.1% to 15% by weight based on the total weight of the lubricating oil.

9. The lubricating oil of claim 1, wherein the diester is present in a concentration ranging from 2.5% to 15% by weight based on the total weight of the lubricating oil.

10. The lubricating fluid oil of claim 1, wherein the $C_4$ to $C_{12}$ carboxylic acids are selected from the group consisting of butanoic acid, hexanoic acid, octanoic acid, decanoic acid, dodecanoic acid, isobutanoic acid, isohexanoic acid, isooctanoic acid, isodecanoic acid, isododecanoic acid, methylhexanoic acid, dimethylhexanoic acid, ethylhexanoic acid, and dimethyloctanoic acid.

11. The lubricating oil of claim 1, wherein the $C_4$ to $C_{12}$ carboxylic acids are selected from the group consisting of butanoic acid, hexanoic acid, octanoic acid, decanoic acid, isobutanoic acid, isohexanoic acid, isooctanoic acid, isodecanoic acid, methylhexanoic acid, dimethylhexanoic acid, ethylhexanoic acid, and dimethyloctanoic acid.

12. The method according to claim 2, wherein the $C_4$ to $C_{12}$ carboxylic acids are selected from the group consisting of butanoic acid, hexanoic acid, octanoic acid, decanoic acid, dodecanoic acid, isobutanoic acid, isohexanoic acid, isooctanoic acid, isodecanoic acid, isododecanoic acid, methylhexanoic acid, dimethylhexanoic acid, ethylhexanoic acid, and dimethyloctanoic acid.

13. The method according to claim 2, wherein the $C_4$ to $C_{12}$ carboxylic acids are selected from the group consisting of butanoic acid, hexanoic acid, octanoic acid, decanoic acid, isobutanoic acid, isohexanoic acid, isooctanoic acid, isodecanoic acid, methylhexanoic acid, dimethylhexanoic acid, ethylhexanoic acid, and dimethyloctanoic acid.

* * * * *